US006054964A

United States Patent [19]

Hansen et al.

[11] Patent Number: 6,054,964

[45] **Date of Patent: *Apr. 25, 2000**

[54] SPLIT ROSETTE-SHAPED MONOPOLE ANTENNA TOP-LOAD FOR INCREASED ANTENNA VOLTAGE AND POWER CAPABILITY

[75] Inventors: Peder M. Hansen; James H. Schukantz, both of San Diego, Calif.; Robert D. Prince, Dale City, Va.

[73] Assignee: The United States of America as represented by the Secretary of the Navy, Washington, D.C.

[ * ] Notice: This patent is subject to a terminal disclaimer.

[21] Appl. No.: 08/866,291

[22] Filed: May 30, 1997

Related U.S. Application Data

[63] Continuation-in-part of application No. 08/232,784, Apr. 21, 1994, Pat. No. 5,673,055.

[51] Int. Cl.[7] ..... H01Q 9/00

[52] U.S. Cl. ..... 343/752; 343/890; 343/899

[58] Field of Search ..... 343/751, 752, 343/890, 899, 745, 749, 853, 915, 792.5, 828, 896

[56] References Cited

U.S. PATENT DOCUMENTS

| | | | |
|---|---|---|---|
| 958,209 | 5/1910 | Von Arco . | |
| 959,100 | 5/1910 | Von Arco . | |
| 2,508,657 | 5/1950 | Toller-Bond . | |
| 2,998,604 | 8/1961 | Seeley . | |
| 3,345,635 | 10/1967 | Fenwick et al. | 343/752 |
| 3,380,061 | 4/1968 | Larson et al. . | |
| 3,386,098 | 5/1968 | Mullaney . | |
| 3,419,873 | 12/1968 | Tanner et al. . | |
| 3,569,970 | 3/1971 | Fenwick . | |
| 4,498,084 | 2/1985 | Werner et al. | 343/792.5 |
| 5,673,055 | 9/1997 | Hansen | 343/752 |

*Primary Examiner*—Don Wong
*Assistant Examiner*—James Clinger
*Attorney, Agent, or Firm*—Harvey Fendelman; Michael A. Kagan; Peter A. Lipovsky

[57] ABSTRACT

In an umbrella top-loaded monopole (UTLM) antenna, the charge distribution on top-load radials increases approximately linearly from the top of the antenna because the activated top-load wires are separating from the tower and each other at the same time they are getting closer to ground. The UTLM antenna of the invention incorporates a top-load configuration in which top-load elements, whether they be radiating or receiving, are arranged in sections of rhombic-shaped frames that originate at the top of the antenna and that extend away from the antenna towards the antenna's base where, at those points of the configuration furthest from the antenna tower and closest to ground at least two top-load elements converge to shield each other and hence reduce charge density. The top-load sections are disposed between the vertical guy wire planes of an antenna to ease their installation, repair and maintenance. The self-shielding effect of the invention permits an antenna to operate at considerably higher voltage. This top-load configuration can also show superior effective height and static capacitance as compared to the traditional UTLM antenna. Because of the efficiency offered by the invention, intrinsic bandwidth and radiated power can be superior to the typical UTLM antenna even with the same top-load voltage limit. Such results can be achieved with half of the traditional number of top-load high voltage insulators.

15 Claims, 10 Drawing Sheets

SPLIT ROSETTE-SHAPED MONOPOLE ANTENNA TOP-LOAD FOR INCREASED ANTENNA VOLTAGE AND POWER CAPABILITY

CROSS-REFERENCE TO RELATED APPLICATION

This application is a continuation-in-part of related application Ser. No. 08/232,784 filed Apr. 21, 1994, now U.S. Pat. No. 5,673,055 and currently allowed.

INCORPORATION BY REFERENCE

Incorporated into this specification is U.S. Pat. No. 5,637,055.

BACKGROUND OF THE INVENTION

This invention relates generally to antennas and without limitation thereto to top-loaded monopole antennas.

The monopole antenna, a vertical element fed against ground, has been used in radio (wireless) communication since the discovery of radio by Tesla and Marconi. The performance of these antennas can be improved by the addition of what is known as "top-loading". Top-loading is particularly effective in the case of electrically short antennas, that is, antennas short in height with respect to wavelength.

Top-loading can be obtained by adding capacitance at the top of an antenna. The top-loading has three major benefits. The first is that the top-loading increases the vertical current moment of the antenna, which increases the radiation resistance of the antenna to thereby increase the antenna's radiation efficiency. For electrically short monopole antennas, this radiation resistance can be theoretically increased by up to a factor of four. The top-loading additionally decreases the feed point reactance of the antenna, which decreases the feed point voltage for a given input current. This has the effect of increasing the power handling capability of the antenna. The amount of this increase is theoretically very large. A final benefit is that the increased capacitance of the top-load causes a decrease in the inherent Q factor of the antenna system, resulting in an increased antenna bandwidth.

A common top-loaded antenna using a single tower is known as an umbrella-top-loaded monopole (UTLM).

The UTLM antenna includes a single base-insulated tower usually supported by structural guy wires. In the typical UTLM antenna, the top-load is provided by sections of the guy wires that are located nearest the top of the antenna structure. These sections, known as active radials or top-load radials, are electrically connected to the antenna tower and extend radially from the tower where they terminate at a primary, high voltage insulator. Non-active sections of the guy wires then extend from the high voltage insulators to the ground and are usually connected through a series of break-up insulators to a ground anchor.

One drawback of this design is that the electric field (potential gradient) is very large at the ends of the active portion of the top-load radials located furthest from the tower. This is because the radials are the furthest separated from the shielding effect offered by the other top-load radials and are closest to the ground.

The electric-field-maximum or voltage-limit of a top-load will be reached when the top-load radials go into corona. The corona forms when the surface electric field of the wires exceeds the breakdown strength of air. Corona causes power loss and radio interference/noise.

The effects of corona, especially power loss, are proportional to frequency. For VLF and even more so for LF antennas, it is undesirable to have any portion of a utilized antenna in corona as it is known that at VLF and LF even a small amount of wire in corona can dissipate a large amount of power.

Disclosed in the referenced and incorporated Patent is a rosette shaped top-load configuration that incorporates top-load elements arranged in rhombic-shaped frames. The rhombic-shaped top-load elements originate at or near the top end of an antenna tower and extend away from the tower towards the antenna's base where, as the elements approach the end of the top-load, they come closer together and hence shield each other to thereby reduce charge density.

This self-shielding permits an antenna to operate at considerably higher voltage levels. This top-load configuration can also exhibit superior effective height and static capacitance as compared to the traditional UTLM antenna. Because of the efficiency offered by this top-load design, intrinsic bandwidth and radiated power can be superior to the typical UTLM antenna, even with the same top-load voltage limit. Such results can be achieved with a fewer number of top-load high voltage insulators than used in traditional UTLMs.

A rosette shaped top-load configuration of contiguously arranged rhombic-shaped top-load elements could require special procedures to install on towers supported by guy wires. The split rosette-shaped monopole top-load configuration described herein is designed to make these special procedures unnecessary.

SUMMARY OF THE INVENTION

The umbrella top-loaded monopole antenna design of the invention incorporates a top-load configuration in which top-load elements are arranged in sections of one or more rhombic-shaped frames designed to be easily erected and utilized with guy-supported monopole antennas. The rhombic-shaped frames of top-load elements originate at or near the top end of an antenna tower and extend away from the antenna tower towards the antenna's base where, as the top-load elements are furthest from the tower, the elements come close together and hence shield each other to thereby reduce charge density. The sections of top-load elements are disposed between the vertical guy wire planes of an antenna, making erection, utilization and maintenance of the rhombic-shaped top-load elements uncomplicated.

OBJECTS OF THE INVENTION

An object of this invention is to provide a top-loaded monopole antenna exhibiting a superior effective height as compared to a typical top-loaded monopole antenna.

Another object of this invention is to provide a top-loaded monopole antenna exhibiting a superior static capacitance as compared to a typical top-loaded monopole antenna.

Yet another object of this invention is to provide a top-loaded monopole antenna that exhibits a superior intrinsic bandwidth as compared to a typical top-loaded monopole antenna.

Still another object of this invention is to provide a top-loaded monopole antenna that exhibits a superior radiated power as compared to a typical top-loaded monopole antenna.

Yet still another object of this invention is to provide a top-loaded monopole antenna that exhibits a superior top-load voltage limit as compared to a typical top-loaded monopole antenna.

Another object of this invention is to provide a top-loaded monopole antenna that decreases the number of top-load voltage insulators as compared to a typical top-loaded monopole antenna.

Still another object of the invention is to provide a top-load for an antenna that provides all the usual benefits of top-loading i.e. increased effective height/efficiency, increased bandwidth and decreased operating voltage, while at the same time allows more power to be radiated for a given size antenna and top-load.

Still another object of the invention is to provide a top-load for an antenna that can be easily installed and utilized with a guy wire supported monopole antenna.

Yet still another object of the invention is to provide a top-load for an antenna that can be easily installed and utilized with a guy wire supported monopole antenna and that provides all the usual benefits of top-loading i.e. increased effective height/efficiency, increased bandwidth and decreased operating voltage, while at the same time allows more power to be radiated for a given size antenna and top-load.

These and other objects of the invention will become apparent from the ensuing specification when considered together with the accompanying drawings.

DESCRIPTION OF THE PREFERRED EMBODIMENT

Most towers used in conjunction with low frequency radio transmission antenna systems are stabilized by sets of guy wires that are attached to the antenna tower at various distances from the ground. The guys are usually located in three vertical planes spaced approximately every 120 degrees around the tower. Two views of a typical guyed tower are shown in FIGS. 1A and 1B.

Figure 1A:
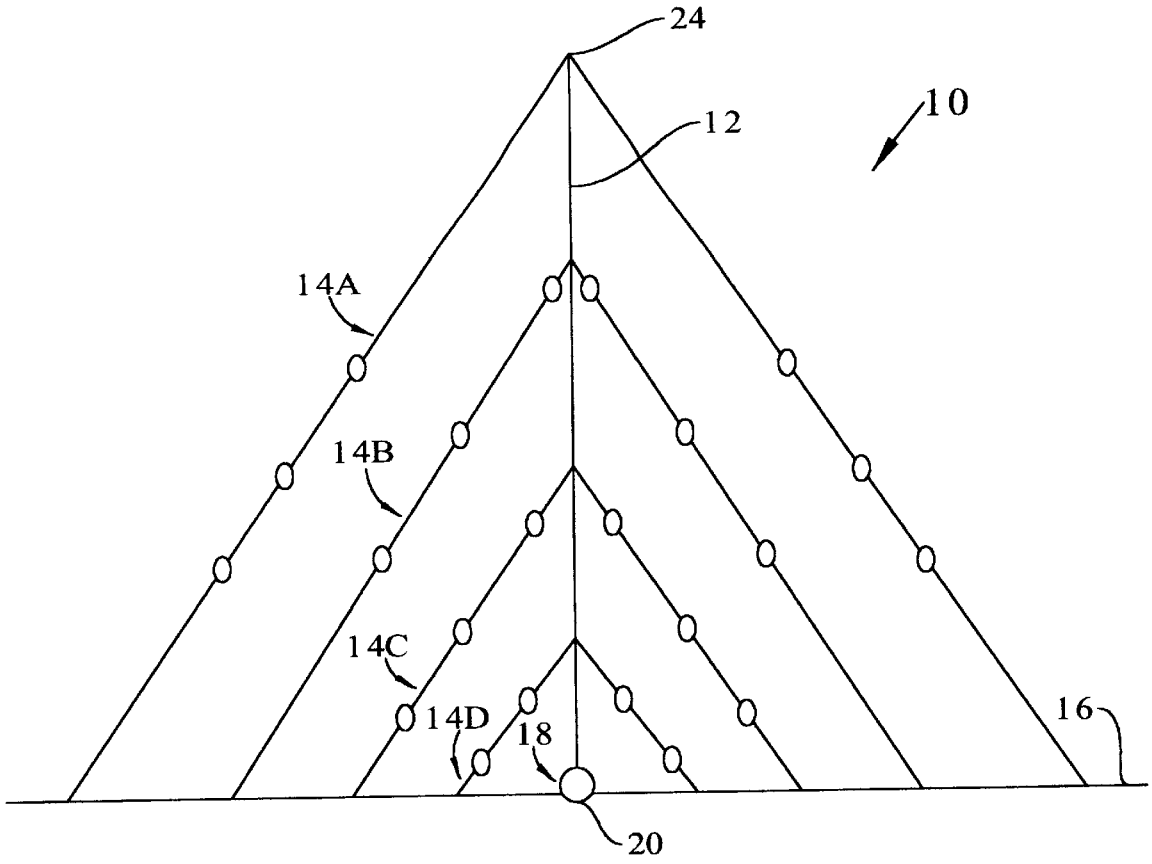
FIG. 1A illustrates an elevation view of a monopole antenna as supported by a number of sets of guy wires.
Figure 1B:
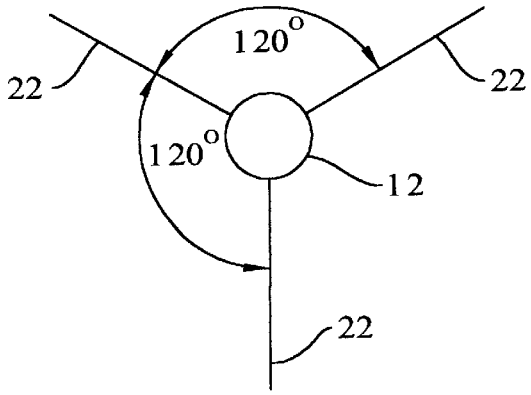
FIG. 1B is a plan view of the guy wire supported antenna of FIG. 1 showing the vertical guy wire planes of this exemplary antenna.

In FIG. 1A, an elevation view of a typical UTLM antenna system 10 is shown. Antenna system 10 includes an antenna tower 12 that is supported substantially vertically by sets of guy wires 14 that extend radially from tower 12 to a ground surface 16 from various heights of the tower. At base 18 of tower 12 is a base insulator 20 that insulates the tower from ground.

Typically, guy wire sets will contain three guy wires at each antenna tower elevation (two wires being shown in a set "A", for example, in FIG. 1A, one wire being removed for clarity). One guy wire of each set is designed to fall within one of three vertical guy wire planes 22. FIG. 1B illustrates generally a plan view of antenna system 10. In this view, vertical guy wire planes are shown spaced every 120 degrees around antenna tower 12.

Of course, other arrangements of guy wire sets and vertical guy wire planes are possible, for example, an antenna system may employ four guy wire planes at roughly every 90 degrees around an antenna tower and guy wire sets would each contain four guy wires, one guy wire for each of the four guy wire planes.

Figure 2:
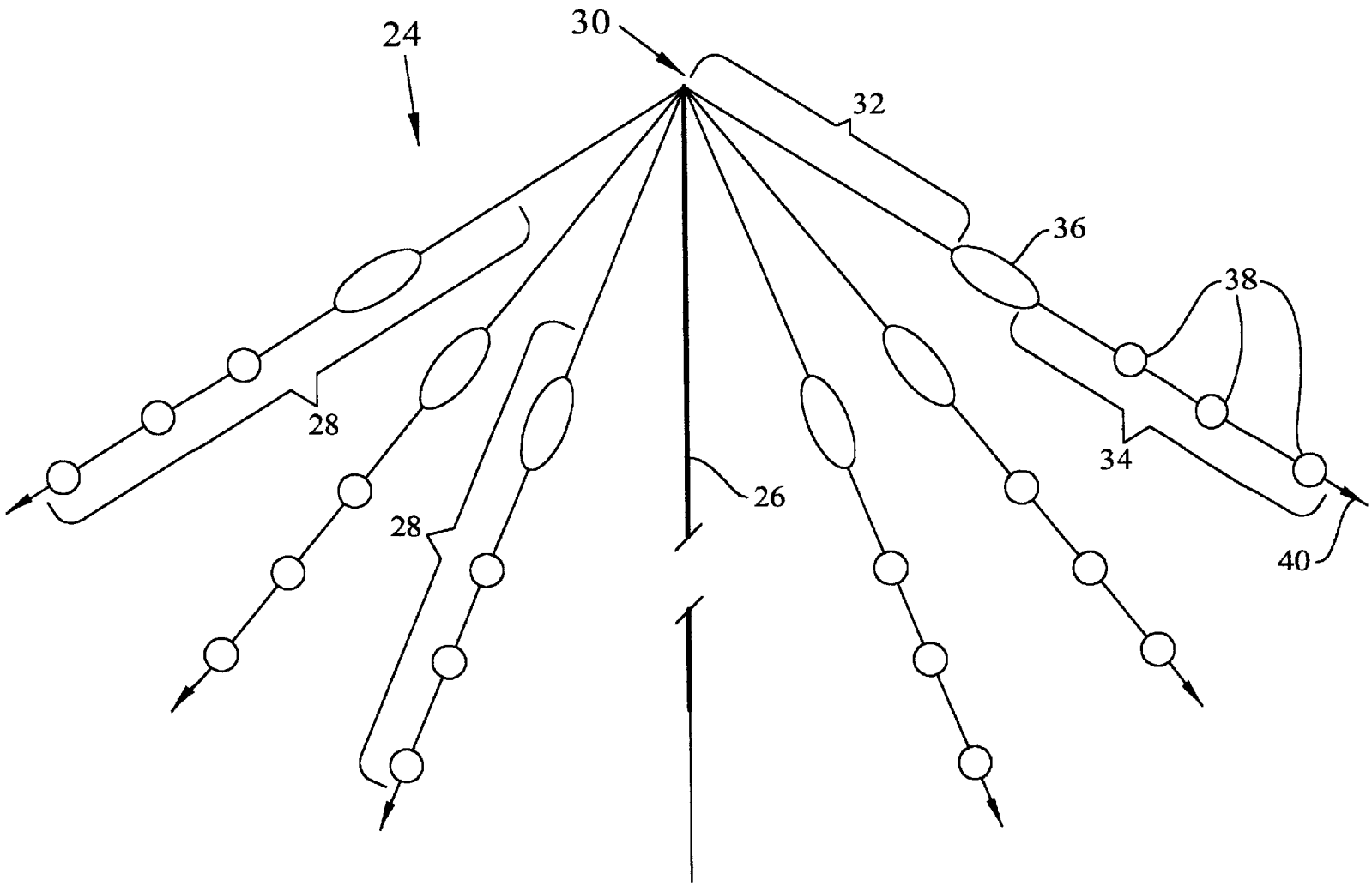
FIG. 2 is an elevation view of a typical top-load for a monopole antenna.

Referring to FIG. 2, a partial, elevation view of an umbrella top-loaded monopole (UTLM) antenna system 24 is shown. System 24 includes an antenna tower 26 that is supported substantially vertically by at least one set of guy wires 28. Guy wires 28 shown are attached at or near to top 30 of the tower. In such a top-loaded monopole antenna, this upper set of guy wires 28 will typically have an upper section 32 and lower section 34. The top-load of antenna system 24 is created when upper sections 32 of guys 28 are activated through electrical connection to tower 26.

These top-load sections 32 are often called the "active radials" or "top-load radials" of the UTLM antenna. The active radials 32 will be insulated from lower section 34 of guy wires 28 by main top-load insulator-couplers 36, one for each guy wire 28. The lower section 34, also known as a support halyard, often includes break-up insulators 38 and a ground anchor 40 that is secured into the ground outlying the tower.

Figure 3:
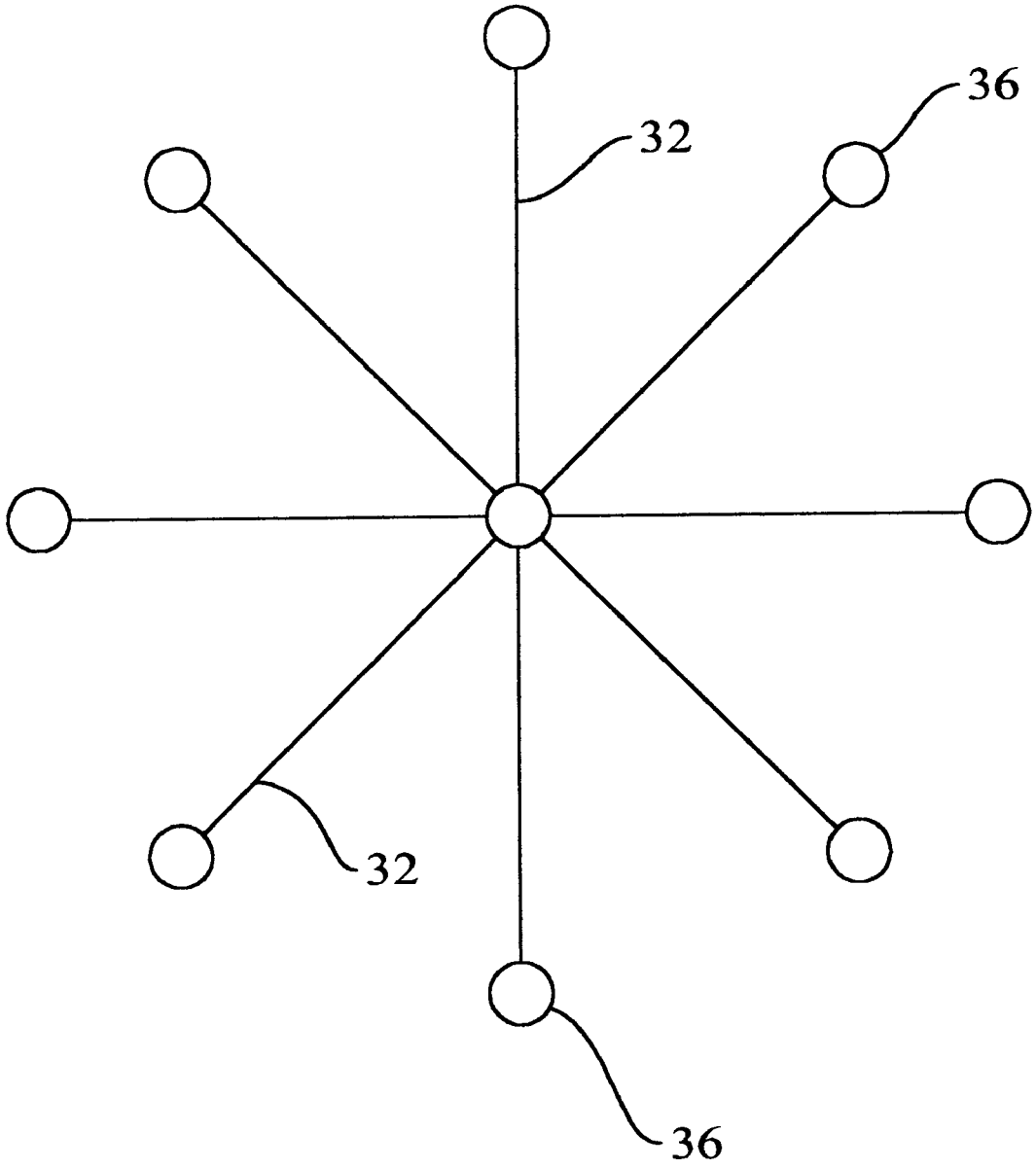
FIG. 3 is a plan view of a typical UTLM antenna top-load showing the antenna tower, active top-load radials and primary insulators only.

In FIG. 3, a traditional UTLM top-load arrangement is shown incorporating eight top-load radials 32 and primary insulators 36. In this figure, the associated support halyards have been omitted for illustration simplicity.

As earlier described, drawbacks of the traditional UTLM top-load configuration are that the electric field can become quite large at the ends of the top-load radials located furthest from the tower. Here the radials are separated the most from the shielding effect of the other top-load radials and are closest to the ground. Another disadvantage of this design is that increasing the top-loading effect requires the addition of radials with the added expense of a complete set of primary and break-up insulators for each added radial.

Figure 4:
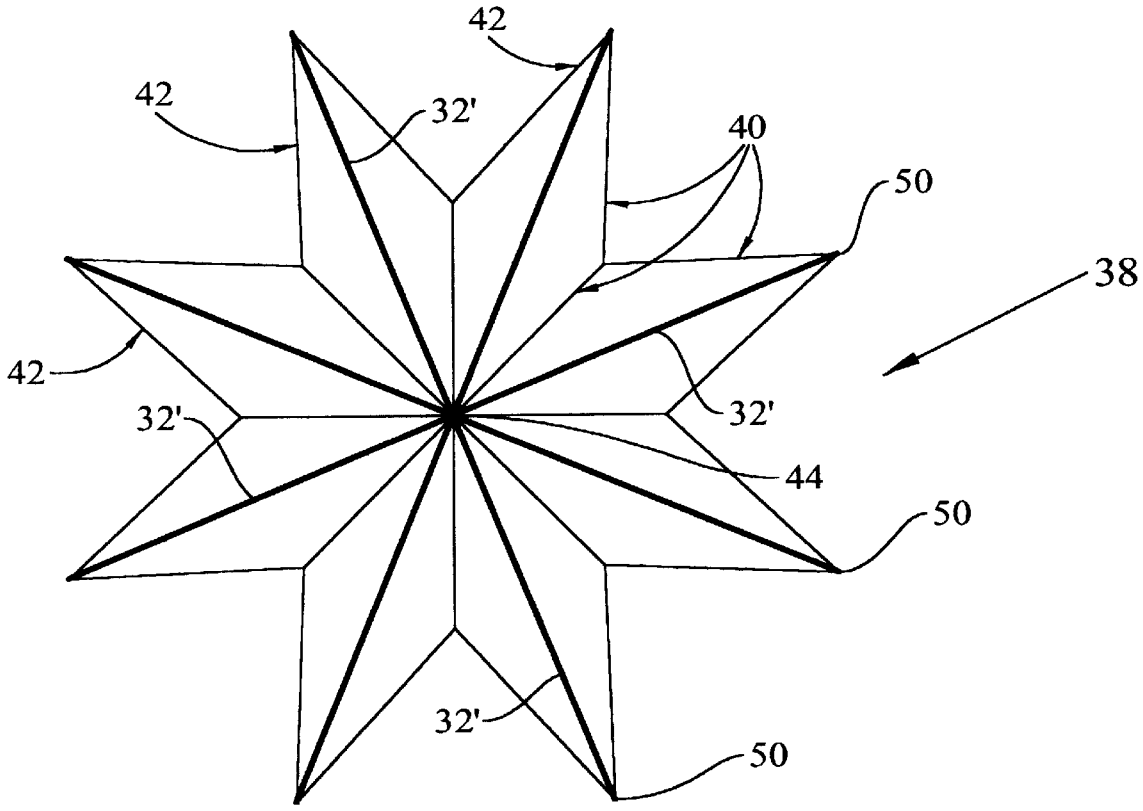
FIG. 4 depicts the active top-load element portion of a rosette shaped top-load employing rhombic-shaped frames of top-load elements.
Figure 5:
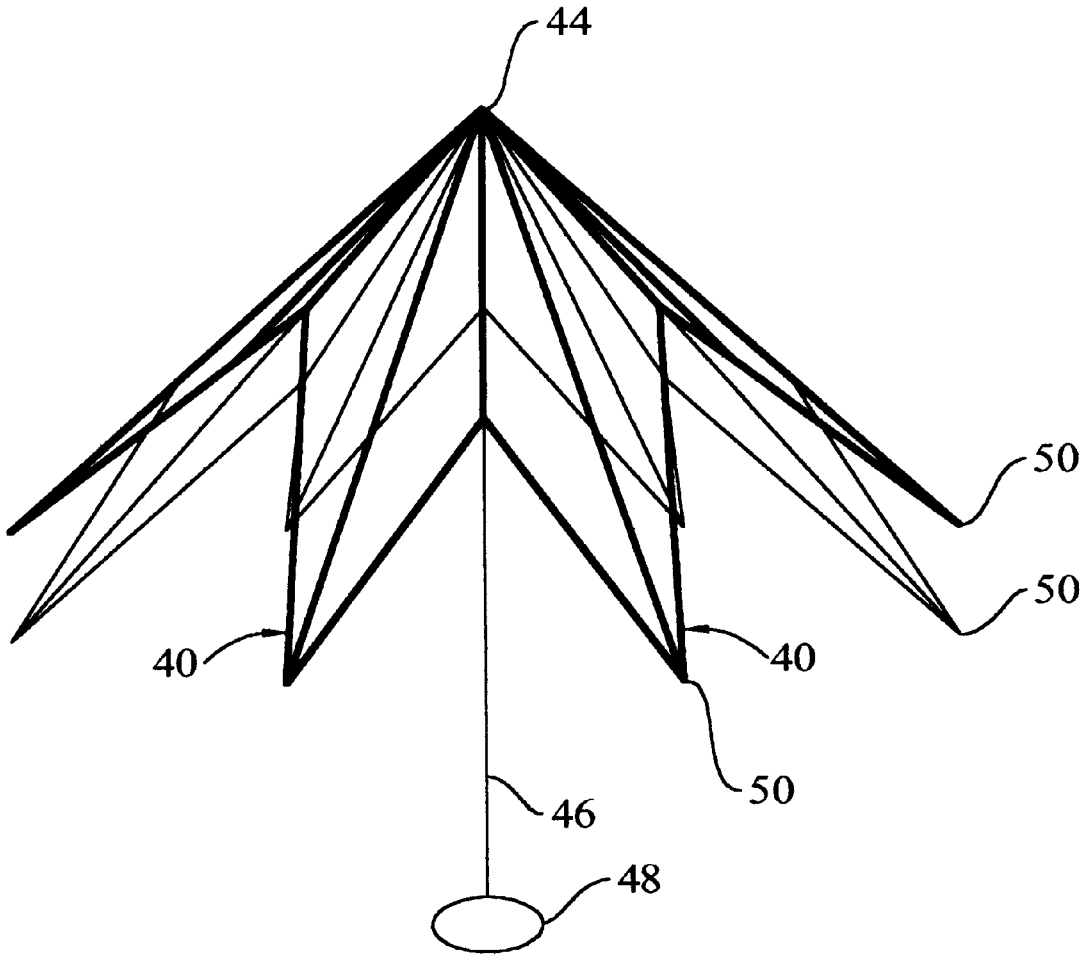
FIG. 5 depicts a side view of the rosette shaped top-load elements of FIG. 4 in which the active top-load radials and tower are illustrated with supporting guy wires removed for clarity.

Referring to FIGS. 4 and 5, a rosette shaped top-load configuration that incorporates top-load elements arranged in rhombic-shaped frames is shown. This top-load has been described and disclosed in U.S. Pat. No. 5,673,055 incorporated by reference herein.

In FIG. 4, rosette shaped top-load configuration 38 is designed to take the place of traditional active top-load elements as shown in FIG. 2. In the embodiment shown, top-load configuration 38 is made from a number of top-load elements 40 arranged to form rhombic shaped frames 42. For simplicity, this figure shows only the top-load elements of the antenna, the support guys have been removed for clarity. In the incorporated patent, a contiguous arrangement of frames 42 is illustrated to constitute a rosette shaped top-load.

As shown in FIGS. 4 and 5, top-load element frames 42 originate at or near top end 44 of antenna tower 46 and extend away from antenna tower 46 toward base 48 of the antenna tower to end at top-load end points 50 where two top-load elements converge. By converging the elements at a point furthest from the tower and closest to the ground, the elements shield each other and thereby reduce the charge density at the ends of the top-load.

In the configuration shown in FIGS. 4 and 5, top-load rhombic-shaped frames 42 need only be supported by their perimeter; however, the panels could be filled-in with other wires in various ways. One practical way to add fill wires is to include a single wire across the center of the panel that continues on to the ground anchor as a support guy. This embodiment is shown in FIGS. 4 and 5 where support guy 32' crosses the center of rhombic-shaped frame 42. Referring to FIG. 2, support guy 32' of FIG. 4 will be attached to the main top-load insulator-couplers 36 and lower guy section 34 to be ultimately fastened to the ground through ground anchor 40. In this arrangement, support guy 32' could be used as an "active" antenna element to increase the static capacitance of the top-load.

As previously described, the self-shielding characteristic of the rhombic-shaped frames of the rosette shaped top-load configuration permits an antenna to operate at considerably higher voltage levels. This design can also exhibit superior effective height and static capacitance as compared to the traditional UTLM antenna. Because of the efficiency offered by this design, intrinsic bandwidth and radiated power can be superior to the typical UTLM antenna, even with the same top-load voltage limit. These results can be achieved with a fewer number of top-load high voltage insulators than used in traditional UTLMs.

A rosette shaped top-load configuration of contiguously arranged rhombic-shaped top-load elements could require special procedures to install on towers supported by guy wires. When one compares the rosette shaped top-load configuration of FIGS. 4 and 5 with the guy wire configuration of FIGS. 1A and 1B, it is clear that part of the rosette must be directly above the guy wires in the guy planes. This could cause difficulty in installing and maintaining the rosette shaped top-load.

To be described is a split rosette-shaped top-load configuration employing sections of rhombic-shaped top-load elements. The sections are disposed between the vertical guy wire planes of an antenna, making erection, utilization and maintenance of the rhombic-shaped top-load elements uncomplicated.

Figure 6:
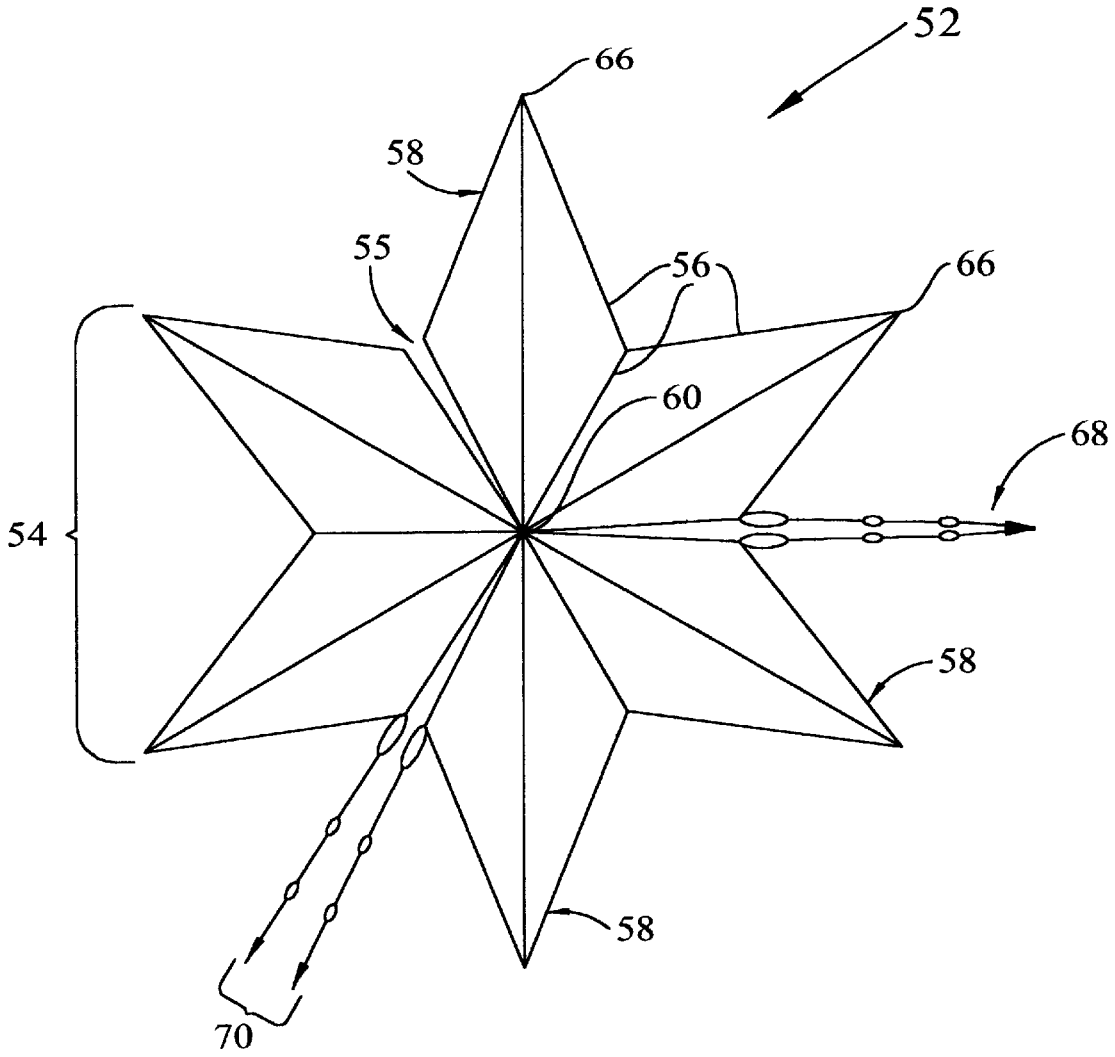
FIGS. 6 and 7 show top and side views, respectively, of an exemplary embodiment of a split rosette top-load incorporating sections of rhombic-shaped top-load frames.
Figure 7:
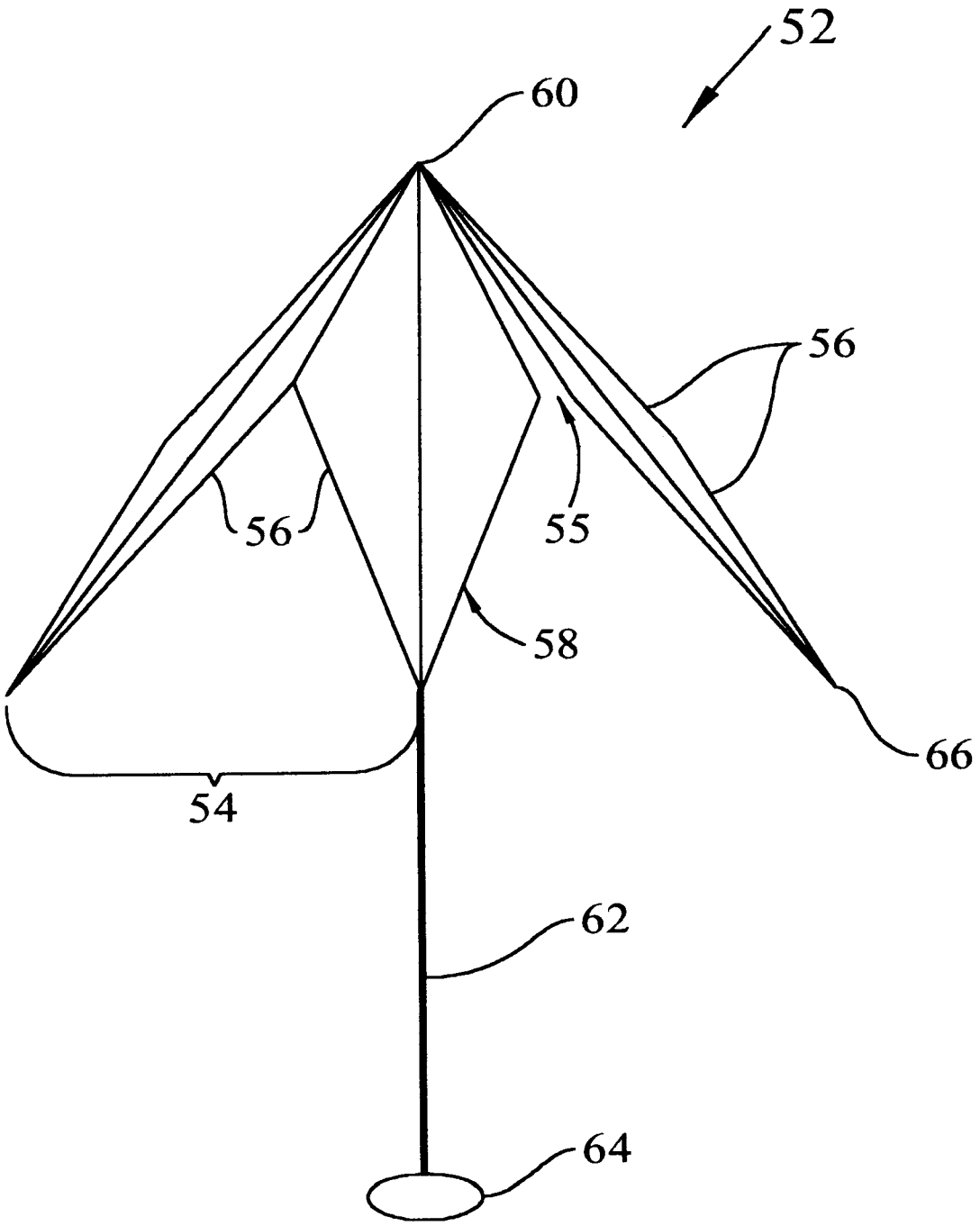

Referring now to FIGS. 6 and 7, top and side views of a split-rosette antenna top-load configuration according to one embodiment of the invention are shown, respectively. Antenna top-load configuration 52 is designed to take the place of active top-load elements 32 of FIG. 2. In the embodiment shown, top-load configuration 52 is made of a number of antenna top-load sections 54 (three being shown) that are operably coupled to an antenna tower. Top-load sections 54 are designed to be disposed between the vertical guy wire planes of a monopole antenna and can be lowered and raised in place without interference from guy wires. As can be seen in FIG. 1B, a monopole antenna may, in one embodiment, be supported by guy wires lying in three vertical guy wire planes 22. In such an arrangement, top-load sections 54 will be designed to fit between these three, 120 degree spaced, planes as is illustrated in FIGS. 6 and 7. In FIG. 6, the vertical guy planes correspond to the "splits" 55 between the top-load sections 54.

Each top-load section 54 is made of top-load elements 56 arranged to form one or more rhombic shaped frames 58. In this embodiment, two frames 58 are disposed contiguously to make up an individual top-load section 54. Of course, one could envision different multiples of rhombic-shaped frames. As shown in FIGS. 6 and 7, frames 58 originate at or near top end 60 of antenna tower 62 and extend away from tower 60 toward base end 64 of the antenna to end at top-load end points 66 where two top-load elements converge. By converging these elements, they shield each other and thereby reduce the charge density at these ends of the top-load.

In the embodiment shown in FIGS. 6 and 7, top-load frames 58 only need to be supported by their perimeter; however, as with the embodiment disclosed in the incorporated patent, the frames could be filled-in with other wires in various ways. A practical way to add fill wires is to include a single wire across the center of the panel that continues on to the ground anchor as a support guy.

This embodiment is shown in FIGS. 6 and 7 where support guy 32" crosses the center of frame 58. Support guy 32" would be substituted for the guys 32 of FIG. 2. Referring again to FIG. 2, support guy 32" of FIGS. 6 and 7 would then be attached to the main top-load insulator-coupler 36 and lower guy section 34 to be ultimately fastened to the ground through ground anchor 40. In this arrangement, support guy 32" could be used as an "active" antenna element to increase the static capacitance of the top-load.

Top-load frames 58 could, in one embodiment, be additionally supported by diverging halyards 68 attached to frames 58 with a primary insulator followed by break-up insulators to the ground or by convergent halyards 70 also attached to the frames with a primary insulator followed by break-up insulators to the ground.

Figure 8:
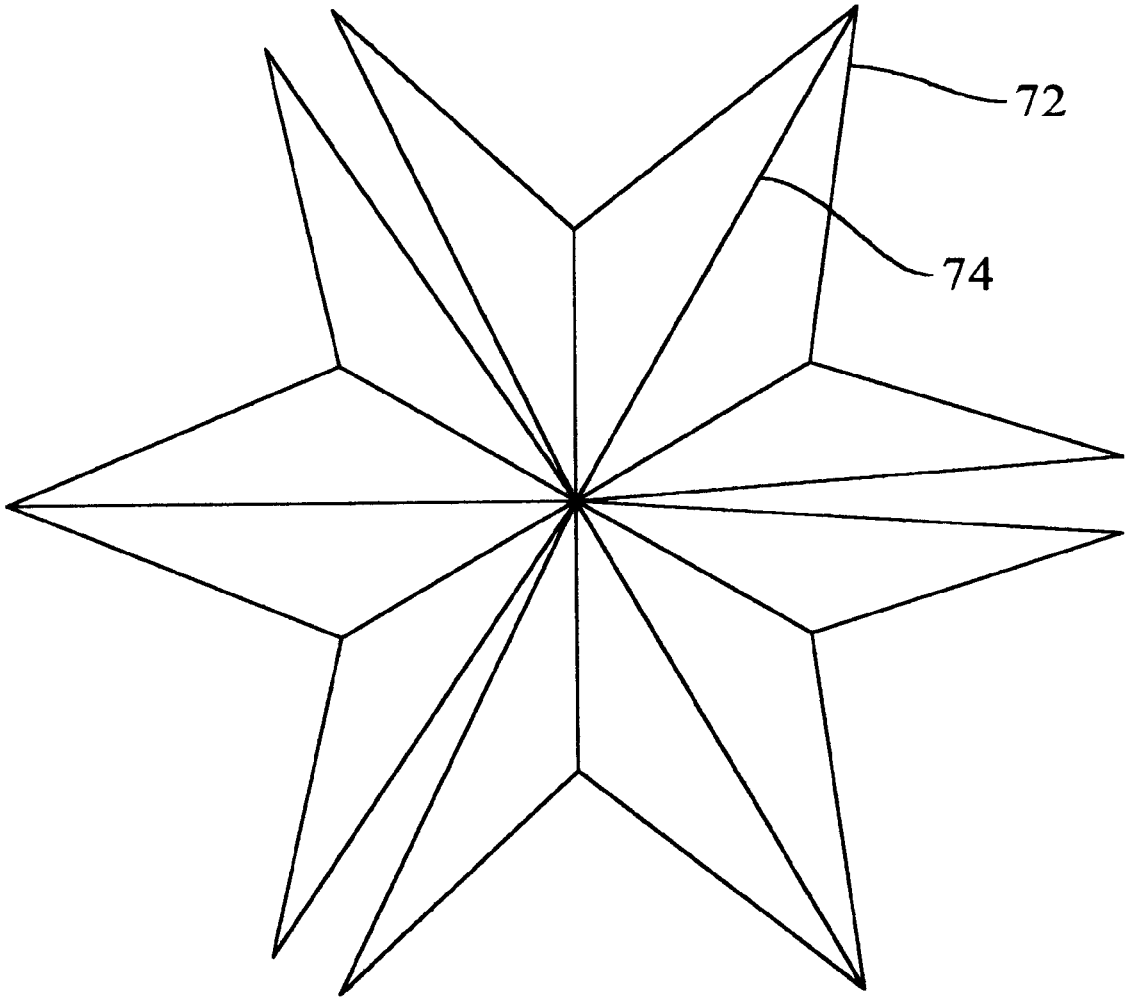
FIG. 8 is an alternative embodiment of the invention employing top-load sections containing a single rhombic-shaped top-load frame.

In FIG. 8. an alternative embodiment is shown in which top-load sections employ one complete rhombic-shaped frame 72 (with fill-lines 73) disposed between two split rhombic frames. In this figure, support halyards and related insulators have been removed for clarity. Other antenna top-load configurations of a various number and configurations of rhombic-shaped top-load frames are of course possible.

Figure 9:
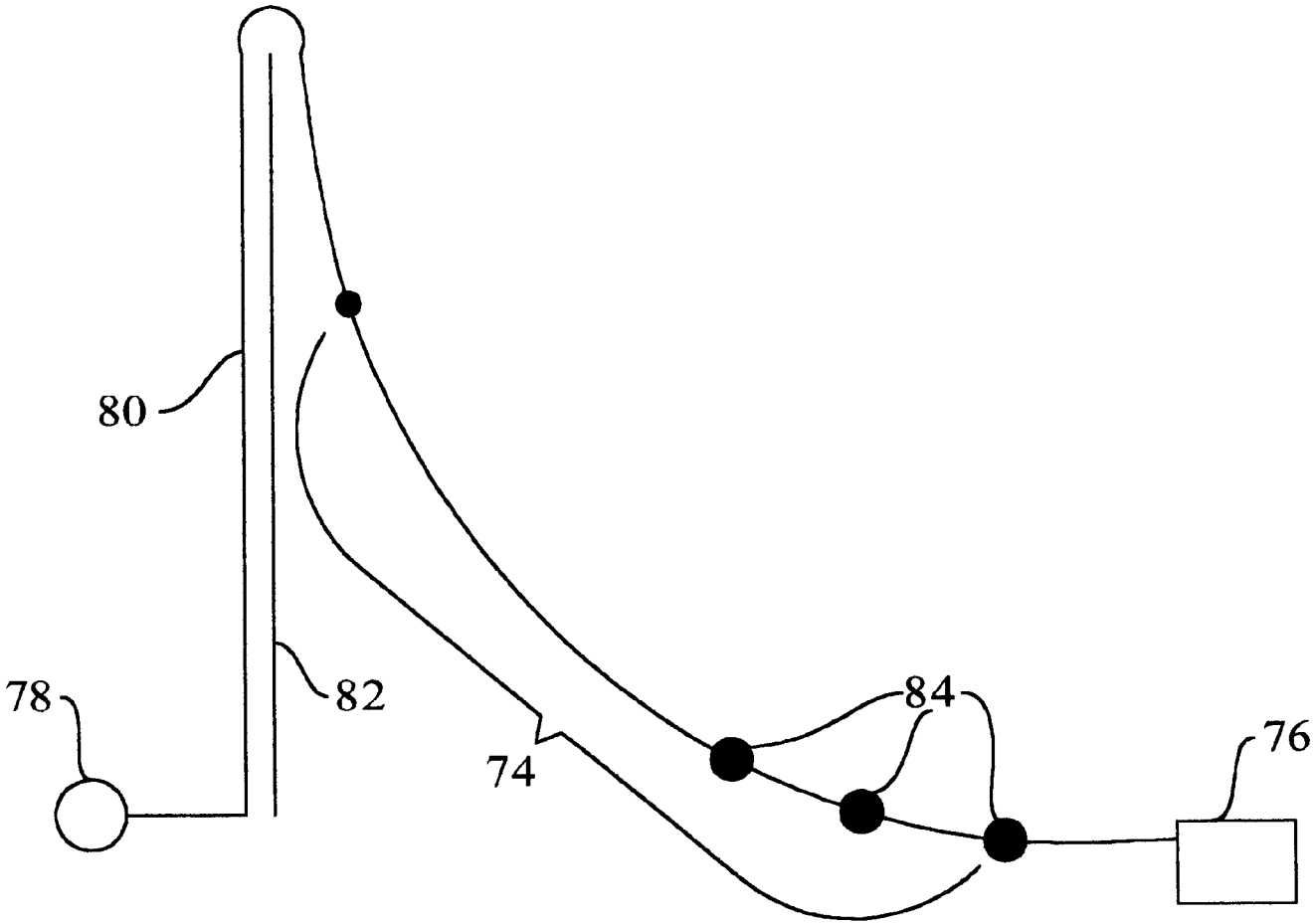
FIGS. 9 and 10 illustrate two embodiments of methods of raising and lowering the top-load sections of the invention.

In FIG. 9 a method of raising and lowering a section of the top-load is illustrated. In this approach, a top-load section 74 attached to anchor 76 is raised and lowered by way of a hoist 78 and halyard 80 rigged over the top of tower 82. An advantage of this technique is that insulators 84 can be touched down upon the ground and made stationary.

Figure 10:
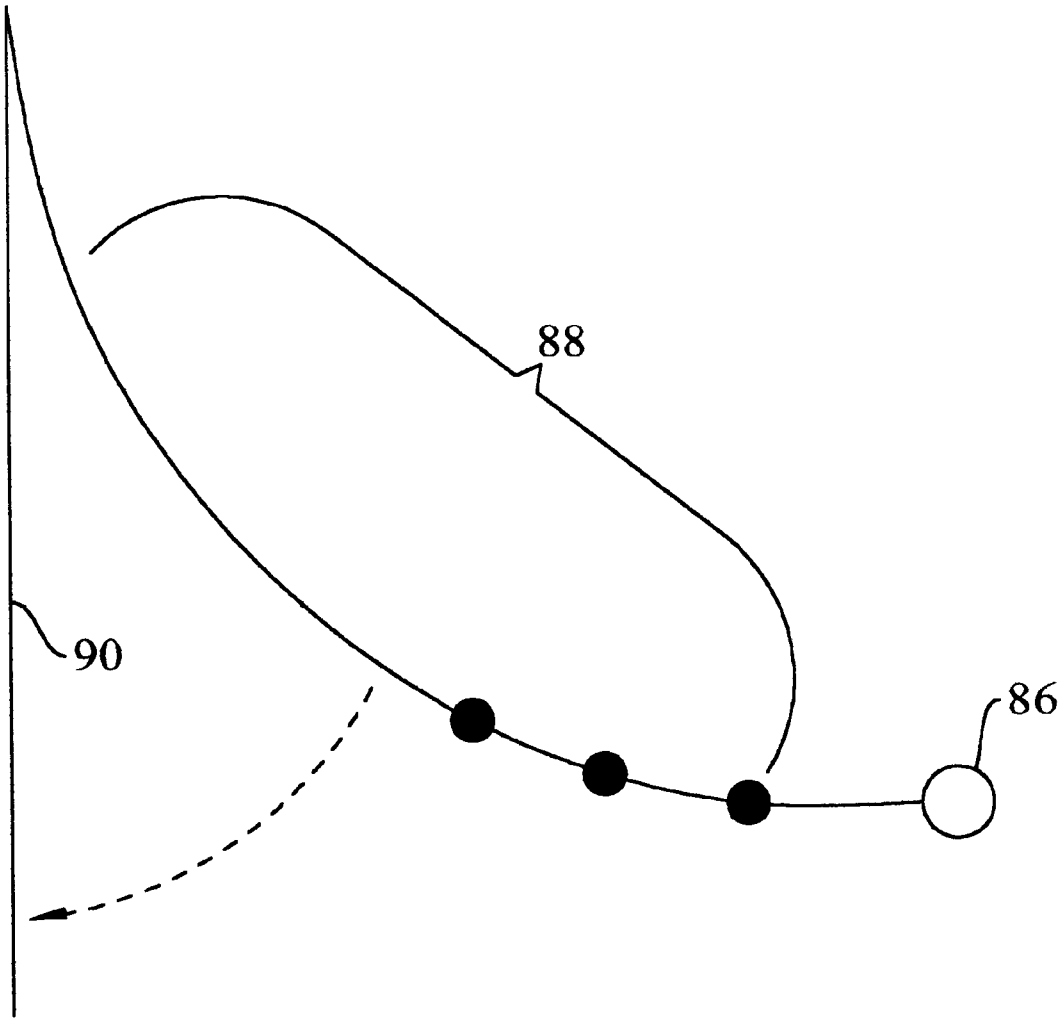

An alternative method of raising and lowering an individual top-load section is illustrated in FIG. 10. In this method, a winch 86 is located at the anchor point or points for the top-load section. As tension in top-load section 88 is relaxed, the top-load section is swung into tower 90 so that the section can be repaired and maintained from the tower.

Modeling the electric properties of the split-rosette top-load employing the rhombic-shaped top-load sections showed that this embodiment performed comparably with the full rosette form disclosed in the incorporated patent application. Computer modelling was also used to calculate the surface electric fields on the top-load. The results indicated performance substantially equivalent to the full rosette.

Obviously, those skilled in the art will realize that other modifications and variations of the invention are possible in light of the above teachings. Therefore, it is to be understood that within the scope of the following claims the invention may be practiced otherwise than as specifically described.

What claimed is:

1. An antenna apparatus comprising:

an antenna tower having a top end and a base end;

a set of guy wires, in which each guy wire of said set is adapted to extend radially from locations on said antenna tower that are the same distance from said base end and in which each of said guy wires is adapted to extend towards said base end within a different vertical guy wire plane of said antenna tower; and a plurality of antenna top-load sections operably coupled to said antenna tower, each of said top-load sections including top-load elements that are adapted to form at least one rhombic-shaped frame that extends radially from said antenna tower and towards said base end between said vertical guy wire planes.

2. An apparatus according to claim 1 in which said antenna tower is a base-insulated monopole antenna.

3. An apparatus according to claim 1 in which there are three of said vertical guy wire planes and in which said vertical guy wire planes are oriented at approximately 120 degree intervals around said antenna tower.

4. An apparatus according to claim 3 in which said set of guy wires includes three guy wires in which one of said guy wires is adapted to lie within a first of said guy wire planes and a second of said guy wires is adapted to lie within a second of said guy wire planes and a third of said guy wires is adapted to lie within a third of said guy wire planes.

5. A apparatus according to claim 1 in which said set of guy wires is one of a plurality of sets of guy wires in which each set of guy wires extends from locations on said antenna tower that are at different distances from said base end of said antenna tower.

6. An apparatus according to claim 5 in which there are three of said vertical guy wire planes and in which said vertical guy wire planes are oriented at approximately 120 degree intervals around said antenna tower.

7. An apparatus according to claim 6 in which each of said sets of guy wires includes three guy wires in which one of said guy wires is adapted to lie within a first of said guy wire planes and a second of said guy wires is adapted to lie within a second of said guy wire planes and a third of said guy wires is adapted to lie within a third of said guy wire planes.

8. An apparatus according to claim 1 in which said top-load elements are radiating/receiving elements.

9. A antenna apparatus comprising:

a substantially vertically disposed base-insulated monopole antenna tower having a top and a base located proximate to a ground surface;

sets of guy wires extending radially from said antenna tower to said ground surface in which each set is attached to said antenna tower at a different distance from said base, and in which, for each of said sets of guy wires, each guy wire of said set lies within a different vertical guy wire plane of said antenna tower in which said vertical guy wire planes are common to all of said sets of guy wires; and antenna top-load sections disposed between said vertical guy wire planes in which each of said top-load sections include top-load elements arranged to form rhombic shaped frames that are operably coupled to said antenna tower and that originate at approximately said top of said antenna tower and that extend away from said antenna tower towards said base to end at a top-load end point where two or more of said top load elements converge.

10. An apparatus according to claim 9 wherein said antenna top-load sections are energized by said antenna tower.

11. A monopole antenna apparatus according to claim 9 in which there are three of said vertical guy planes and in which said vertical guy wire planes are oriented at approximately 120 degree intervals around said monopole antenna tower.

12. An apparatus according to claim 11 in which each of said sets of guy wires includes three guy wires in which one of said guy wires lies within a first of said guy wire planes and a second of said guy wires lies within a second of said guy wire planes and a third of said guy wires lies within a third of said guy wire planes.

13. A antenna apparatus comprising:

a base-insulated monopole antenna tower having a top and a base proximate to a ground surface;

sets of guy wires attached to said antenna tower at different distances from said base of said antenna tower, in which for each of said sets of guy wires, each guy wire of said set extends radially from said antenna tower to said ground surface within a different vertical guy wire plane of said antenna tower and in which said vertical guy wire planes are common to all of said sets of guy wires and are oriented at 120 degrees around said antenna tower; and three antenna top-load sections, one of said antenna top-load sections being disposed between each of said vertical guy wire planes, each of said antenna top-load sections including top-load elements arranged to form at least one rhombic-shaped frame that originates at approximately said top of said antenna tower and that extends away from said antenna tower towards said base of said antenna to end at a top-load end point where two or more of said top load elements converge.

14. A antenna apparatus according to claim 13 in which said top-load elements are radiating/receiving elements.

15. A antenna apparatus according to claim 13 in which said top-load sections are energized by said antenna.

* * * * *